US009784220B2

(12) United States Patent
Jun et al.

(10) Patent No.: US 9,784,220 B2
(45) Date of Patent: Oct. 10, 2017

(54) INTAKE AIR CONTROL APPARATUS OF ENGINE

(71) Applicant: HYUNDAI MOTOR COMPANY, Seoul (KR)

(72) Inventors: JongMan Jun, Hwaseong-si (KR); Hyoung Hyoun Kim, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 165 days.

(21) Appl. No.: 14/703,837

(22) Filed: May 4, 2015

(65) Prior Publication Data

US 2016/0090950 A1 Mar. 31, 2016

(30) Foreign Application Priority Data

Sep. 30, 2014 (KR) ..... 10-2014-0131636

(51) Int. Cl.
*F02M 26/64* (2016.01)
*F02M 25/07* (2006.01)
(Continued)

(52) U.S. Cl.
CPC ..... *F02M 25/0724* (2013.01); *F02M 26/21* (2016.02); *F02M 26/54* (2016.02);
(Continued)

(58) Field of Classification Search
CPC ..... F02M 26/64; F02M 26/06; F02M 26/21; F02M 26/70; F02M 26/54; F02M 35/10222; F02D 11/10; F02D 41/0077; F16K 11/22
See application file for complete search history.

(56) References Cited

U.S. PATENT DOCUMENTS 8,381,520 B2 * 2/2013 Leroux ..... F02M 26/06 123/568.15
8,862,369 B2 * 10/2014 Vitiello ..... F02D 11/10 123/568.12
(Continued)

FOREIGN PATENT DOCUMENTS

DE 10 2013 105 839 A1 * 12/2014
JP 2002-266664 A 9/2002
(Continued)

*Primary Examiner* — Hung Q Nguyen
*Assistant Examiner* — Xiao Mo
(74) *Attorney, Agent, or Firm* — McDermott Will & Emery LLP

(57) ABSTRACT

An intake air control apparatus of an engine includes a housing having an intake air inflow passage for receiving external air, an exhaust gas inflow passage for receiving recirculated exhaust gas, and an intake air supply passage for supplying the external air from the intake air inflow passage or the exhaust gas from the exhaust gas inflow passage to the engine. A motor gear rotates together with an output shaft of the motor. A connection gear is engaged and rotates together with the motor gear. A recirculation gear is engaged and rotates together with the connection gear. A recirculation valve opens and closes the exhaust gas inflow passage since the recirculation valve rotates together with the recirculation gear. An intake air gear is engaged and rotates together with the connection gear. An intake air throttle valve opens and closes the intake air inflow passage.

15 Claims, 7 Drawing Sheets

(51) Int. Cl.

| | |
|---|---|
| ***F02M 26/21*** | (2016.01) |
| ***F02M 26/54*** | (2016.01) |
| ***F02M 26/70*** | (2016.01) |
| *F02M 35/10* | (2006.01) |

(52) U.S. Cl.
CPC ..... *F02M 26/64* (2016.02); *F02M 26/70* (2016.02); *F02M 35/10222* (2013.01)

(56) References Cited

U.S. PATENT DOCUMENTS

| | | | | |
|---|---|---|---|---|
| 9,145,854 | B2 * | 9/2015 | Hodebourg | F02D 41/0077 |
| 9,273,786 | B2 * | 3/2016 | Hodebourg | F16K 11/22 |
| 2011/0048004 | A1 * | 3/2011 | Leroux | F02M 26/06 60/605.2 |

FOREIGN PATENT DOCUMENTS

| | | | |
|---|---|---|---|
| JP | 4380072 | B2 | 12/2009 |
| JP | 2010-163996 | A | 7/2010 |
| KR | 10-1338272 | B1 | 12/2013 |
| KR | 10-1376775 | B1 | 4/2014 |

* cited by examiner

INTAKE AIR CONTROL APPARATUS OF ENGINE

CROSS-REFERENCE TO RELATED APPLICATION

This application claims the benefit of priority to Korean Patent Application No. 10-2014-0131636 filed in the Korean Intellectual Property Office on Sep. 30, 2014, the entire content of which is incorporated herein by reference.

TECHNICAL FIELD

The present disclosure relates to an intake air control apparatus of an engine, and more particularly, to an intake air control apparatus of an engine which may enable recirculation of a low pressure exhaust gas.

BACKGROUND

An internal combustion engine of a vehicle operates by energy generated when a mixed gas is combusted in a combustion chamber. The mixed gas includes air and a fuel. An intake air passage, through which the mixed gas or air to be mixed with the fuel is supplied, is connected to a cylinder of the engine. Here, the mixed gas or the air is collectively called intake air of the engine.

A diesel engine includes an exhaust gas recirculation apparatus configured to recirculate exhaust gas which is used as intake air of the engine, thus reducing emission of NOx. An exhaust gas recirculation passage through which the exhaust gas recirculates is connected to the intake air passage. The exhaust gas recirculation passage may include a valve for the recirculated exhaust gas to be selectively supplied to the intake air passage.

The exhaust gas recirculation valve for controlling exhaust gas or a valve housing encasing the valve is exposed to high temperature exhaust gas, thus deteriorating operation performance and durability of the valve. In addition, when the valve and the valve housing made of a material having excellent heat resistance to withstand the high temperature exhaust gas are used, manufacturing costs of the valve and the valve housing excessively increase.

The above information disclosed in this Background section is only for enhancement of understanding of the background of the disclosure, and therefore, it may contain information that does not form the prior art that is already known in this country to a person of ordinary skill in the art.

SUMMARY

The present disclosure has been made in an effort to provide an intake air control apparatus of an engine wherein manufacturing costs may be saved while improving operation performance and durability.

The present disclosure has also been made in an effort to provide an intake air control apparatus of an engine capable of reducing emission of harmful exhaust gas.

According to an exemplary embodiment of the present inventive concept, an intake air control apparatus of an engine includes a housing having an intake air inflow passage for receiving external air, an exhaust gas inflow passage for receiving recirculated exhaust gas, and an intake air supply passage for supplying the external air from the intake air inflow passage or the exhaust gas from the exhaust gas inflow passage to the engine. A motor is a driving force source. A controller is configured to control the motor. A motor gear rotates together with an output shaft of the motor. A connection gear is engaged and rotates together with the motor gear. A recirculation gear is engaged and rotates together with the connection gear. A recirculation valve opens and closes the exhaust gas inflow passage since the recirculation valve rotates together with the recirculation gear. An intake air gear is engaged and rotates together with the connection gear. An intake air throttle valve opens and closes the intake air inflow passage since the intake air throttle valve rotates together with the intake air gear.

The recirculation valve and the intake air throttle valve may rotate with a predetermine time difference since the connection gear and the intake air gear are engaged with each other at a moment in which the recirculation valve rotates by the motor when the recirculation valve closes the exhaust gas inflow passage and the intake air throttle valve opens the intake air inflow passage.

The connection gear may be a three-shift gear having a motor connection gear rotatably engaged with the motor gear, a recirculation connection gear rotatably engaged with the recirculation gear, and an intake air connection gear rotatably engaged with the intake air gear. The motor connection gear, the recirculation connection gear, and the intake air connection gear may integrally rotate.

The intake air connection gear may include a gear omission unit on which gear teeth of the intake air connection gear are omitted at a predetermined angle.

The gear teeth of the intake air gear may be positioned at the gear omission unit of the intake air connection gear in a state in which the recirculation valve closes the exhaust gas inflow passage and the intake air throttle valve fully opens the intake air inflow passage.

The intake air connection gear and the intake air gear may be engaged with each other since the connection gear rotates while the recirculation valve opens the exhaust gas inflow passage by operation of the motor.

The recirculation gear may have a fan shape on which gear teeth are formed at an obtuse angle.

The intake air gear may maintains the engagement with the intake air connection gear and rotate in order for the intake air throttle valve to close the intake air inflow passage after the recirculation valve fully opens the exhaust gas inflow passage.

The housing may be made of an aluminum material.

The intake air gear may have a fan shape on which gear teeth thereof are formed at an obtuse angle.

The recirculation gear may have a fan shape on which gear teeth thereof are formed at an obtuse angle.

DETAILED DESCRIPTION

Exemplary embodiments of the present inventive concept will hereinafter be described in detail with reference to the accompanying drawings.

Figure 1:
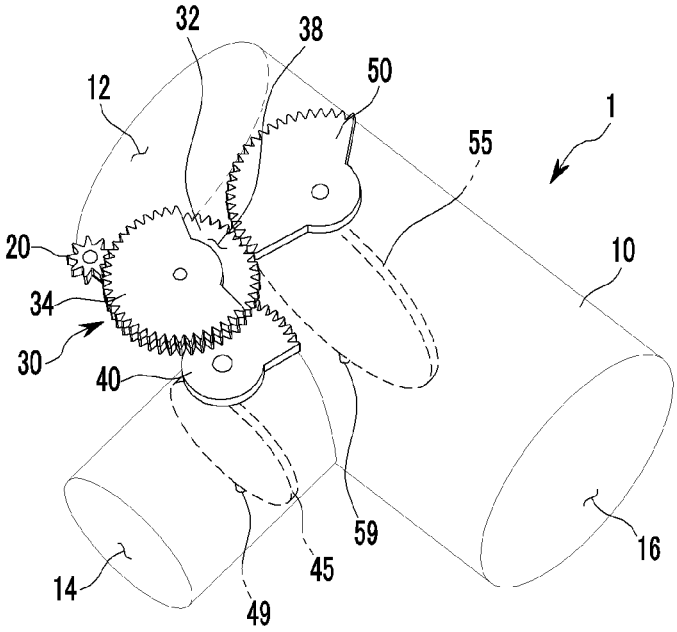
FIG. 1 is a perspective view illustrating an intake air control apparatus of an engine according to an exemplary embodiment of the present inventive concept.
Figure 2:
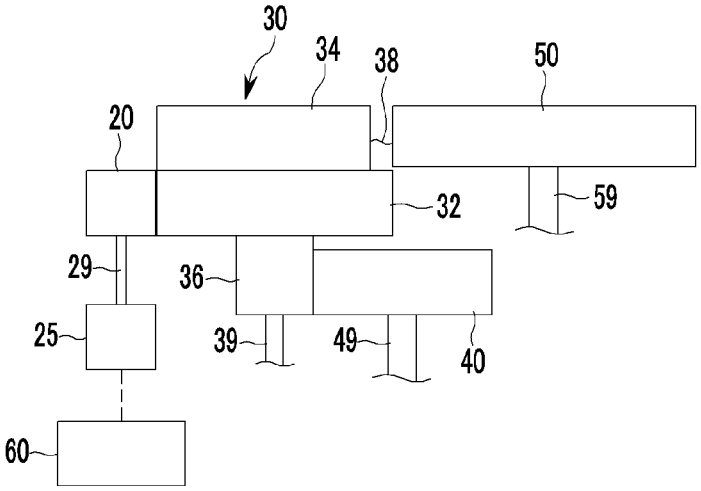
FIG. 2 is a schematic view illustrating a gear connection relationship of an intake air control apparatus of an engine according to an exemplary embodiment of the present inventive concept.
Figure 3:
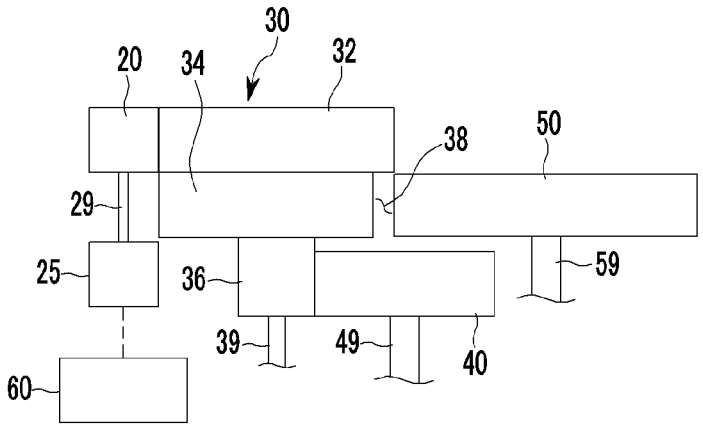
FIG. 3 is a schematic view illustrating a gear connection relationship of an intake air control apparatus of an engine according to another exemplary embodiment of the present inventive concept.

FIG. 1 is a perspective view illustrating an intake air control apparatus of an engine according to an exemplary embodiment of the present inventive concept, FIG. 2 is a schematic view illustrating a gear connection relationship of an intake air control apparatus of an engine according to an exemplary embodiment of the present inventive concept, and FIG. 3 is a schematic view illustrating a gear connection relationship of an intake air control apparatus of an engine according to another exemplary embodiment of the present inventive concept.

Referring to FIGS. 1 to 3, an intake air control apparatus 1 of an engine according to an exemplary embodiment of the present inventive concept includes a housing 10, a motor gear 20, a connection gear 30, a recirculation gear 40, a recirculation valve 45, an intake air gear 50, and an intake air throttle valve 55.

The housing 10 serves as a case in which the components of the intake air control apparatus 1 are disposed. In addition, the housing 10 includes an intake air inflow passage 12, an exhaust gas inflow passage 14, and an intake air supply passage 16.

The housing 10 has a first hollow pipe shape. One end of the first hollow pipe forms the intake air inflow passage 12 and another end of the first hollow pipe forms the intake air supply passage 16. The housing 10 includes a second hollow pipe shape which is branched from the first hollow pipe shape. One end of the second branched hollow pipe forms the exhaust gas inflow passage 14. Thus, a central portion of the housing 10 is connected to three passages 12, 14, and 16.

The intake air inflow passage 12 receives external air to supply it to the engine.

The exhaust gas inflow passage 14 receives recirculated exhaust gas so as to supply it to the engine. Since a recirculation method of exhaust gas is obvious to a person having ordinary skill in the art, the detailed descriptions thereof will be omitted.

The intake air supply passage 16 supplies the external air from the intake air inflow passage 12 or the exhaust gas from the exhaust gas inflow passage 14 to the engine as intake air. The intake air supply passage 16 communicates with an intake manifold (not illustrated) which is a passage for guiding the intake air to each cylinder of the engine. That is, the intake air control apparatus 1 of an engine according to an exemplary embodiment of the present inventive concept is installed in an intake air section of the engine. The intake air supply passage 16 in general communicates with a front end of a turbocharger (not illustrated) in order for the intake air to be supplied through the turbocharger and an intercooler (not illustrated) to the intake manifold (not illustrated).

Since the intake air control apparatus 1 is installed in the intake air section of the engine, the housing 10 may be prevented from being exposed to a high temperature. Therefore, a low pressure exhaust gas may be inputted into the exhaust gas inflow passage 14 in a high load state of the engine. In addition, components of the intake air control apparatus 1 including the housing 10 may be made from a relatively cheaper material than a material which has strong heat resistance of the related art. Since the recirculation method of the low pressure exhaust gas is obvious to a person having ordinary skill in the art, the detailed descriptions thereof will be omitted.

The motor gear 20 is connected to an output shaft 29 of the motor 25 to directly receive or transfer a rotational force of the motor 25. The motor 25 may be an electric motor which operates as a driving force source of the intake air control apparatus 1. In addition, the motor 25 is controlled by a controller 60. The controller 60 may be a conventional electronic control unit (ECU) which comprehensively controls electronic components of a vehicle.

The connection gear 30 is a three-shift gear including a motor connection gear 32, an intake air connection gear 34, and a recirculation connection gear 36. The motor connection gear 32, the intake air connection gear 34, and the recirculation connection gear 36 integrally and concentrically rotate about a connection gear rotary shaft 39. The motor connection gear 32, the intake air connection gear 34, and the recirculation connection gear 36 may each have different radiuses. Referring to FIGS. 1 to 6, the motor connection gear 32 and the intake air connection gear 34 have the same radius and the radius of the recirculation connection gear 36 is relatively smaller, but is not limited thereto.

The motor connection gear 32 and the motor gear 20 are engaged with each other and rotate together. In addition, the connection gear rotary shaft 39 is rotatably connected to a fixture, and the fixture may be the housing 10.

The recirculation gear 40 is engaged and rotates together with the recirculation connection gear 36. The recirculation gear 40 may have a fan shape on which gear teeth are formed over obtuse angles or may have a circle shape.

The recirculation valve 45 is disposed at an inner side of the exhaust gas inflow passage 14 and integrally rotates together with the recirculation gear 40. The exhaust gas inflow passage 14 is open or closed based on the rotations of the recirculation valve 45. More specifically, the recirculation gear 40 receives the rotational force of the motor 25 through the motor gear 20 and the recirculation connection gear 36, and enables the recirculation valve 45 to selectively rotate by the rotational force of the motor 25 in accordance with control of the controller 60. Therefore, the exhaust gas inflow passage 14 is selectively open and closed in accordance with the control of the controller 60.

The recirculation valve 45 has a recirculation valve shaft 49 which is a center of rotation of the recirculation valve 45 and the recirculation gear 40. The recirculation valve shaft 49 is connected to the recirculation gear 40 in order for the recirculation valve 45 and the recirculation gear 40 to integrally rotate. The recirculation valve shaft 49 is rotatably connected to the fixture which may be the housing 10.

The intake air gear 50 is engaged with the intake air connection gear 34 and rotates together therewith. In addition, the intake air gear 50 may have a fan shape on which gear teeth are formed over obtuse angles or have a circle shape. The intake air connection gear 34 has a gear omission unit 38 from which the gear teeth are omitted over predetermined angles.

The intake air throttle valve 55 is disposed at an inner side of the intake air inflow passage 12. In addition, the intake air throttle valve 55 integrally rotates together with the intake air gear 50, and the intake air inflow passage 12 is open and closed in accordance with the rotation of the intake air throttle valve 55. That is, the intake air throttle valve 55 receives the rotational force of the motor 25 through the motor gear 20 and the intake air connection gear 34 and selectively rotates the intake air throttle valve 55 by the rotational force of the motor 25 in accordance with control of the controller 60. Therefore, the intake air inflow passage 12 is selectively open and closed in accordance with control of the controller 60.

When the gear omission unit 38 of the intake air connection gear 34 is provided at a side of the intake air gear 50 based on the rotation of the intake air connection gear 34, the intake air connection gear 34 and the intake air gear 50 are disengaged.

The intake air throttle valve 55 has an intake air valve shaft 59 which is the center of rotation of the intake air throttle valve 55 and the intake air gear 50. The intake air valve shaft 59 is connected to the intake air gear 50 in order for the intake air throttle valve 55 and the intake air gear 50 to integrally rotate. In addition, the intake valve shaft 59 is rotatably connected to the fixture which may be the housing 10.

Referring to FIG. 2, in the connection gear 30 formed of the motor connection gear 32, the intake air connection gear 34, and the recirculation connection gear 36 in an exemplary embodiment of the present inventive concept, the intake air connection gear 34, the motor connection gear 32, and the recirculation connection gear 36 are sequentially disposed from an upper side to a lower side. In FIG. 3, in the connection gear 30 formed of the motor connection gear 32, the intake air connection gear 34, and the recirculation connection gear 36 in another exemplary embodiment of the present inventive concept, the motor connection gear 32, the intake air connection gear 34, and the recirculation connection gear 36 are sequentially disposed from an upper side to a lower side. In this way, the motor connection gear 32, the intake air connection gear 34, and the recirculation connection gear 36, and the motor gear 20, the intake air gear 50, and the recirculation gear 40 which are engaged with the motor connection gear 32, the intake air connection gear 34, and the recirculation connection gear 36, respectively, may be disposed in various ways by a person having ordinary skill in the art, and such various arrangements are not limited to the exemplary embodiments of the present inventive concept.

Figure 4:
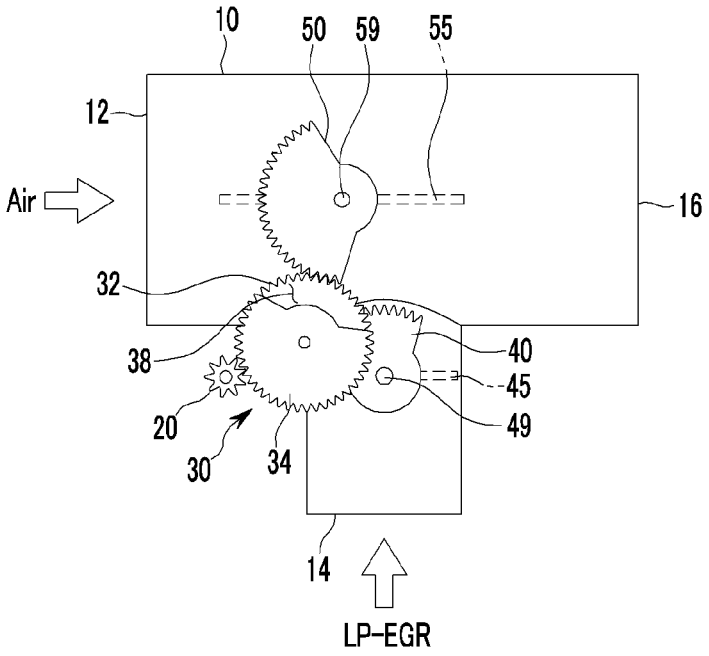
FIGS. 4 to 6 are views illustrating operations of an intake air control apparatus of an engine according to an exemplary embodiment of the present inventive concept.
Figure 5:
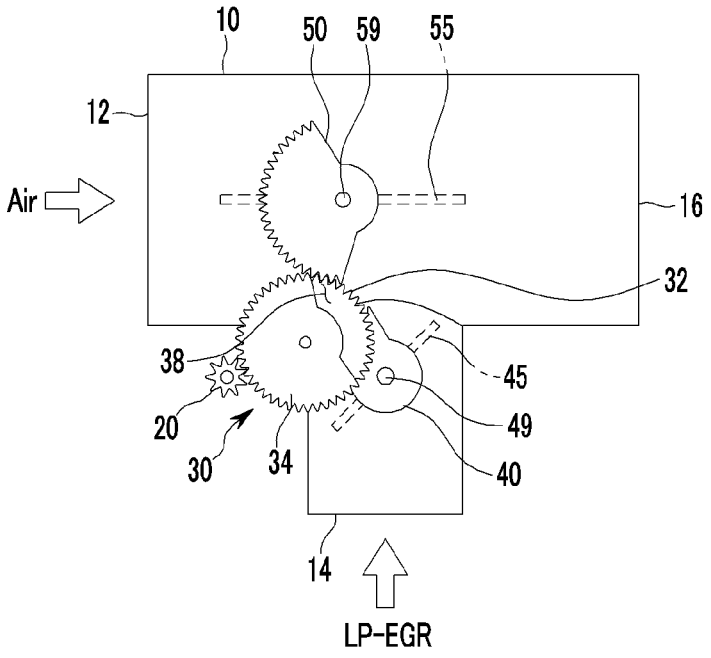
Figure 6:
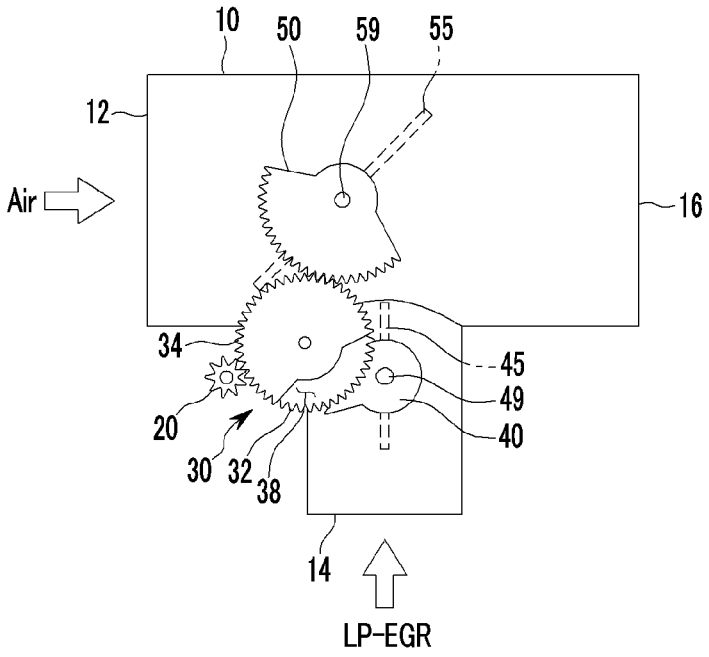

FIGS. 4 to 6 are views illustrating operations of the intake air control apparatus of an engine according to an exemplary embodiment of the present inventive concept.

FIG. 4 illustrates a configuration wherein the intake air inflow passage 12 is open, and the exhaust gas inflow passage 14 is closed.

Referring to FIG. 4, in a state where the intake air throttle valve 55 is disposed to open the intake air inflow passage 12, the gear teeth of the intake air gear 50 are positioned at the gear omission unit 38 of the intake air connection gear 34. That is, the intake air connection gear 34 and the intake air gear 50 are disengaged. Here, the recirculation connection gear 36 is engaged with the recirculation gear 40 in a state where the recirculation valve 45 is disposed to close the exhaust gas inflow passage 14.

FIG. 5 illustrates a configuration wherein the closing of the intake air inflow passage 12 starts while the opening of the exhaust gas inflow passage 14 is occurring.

Referring to FIG. 5, when the motor gear 20 rotates in a counterclockwise direction from the state in FIG. 4, the motor connection gear 32 engaged with the motor gear 20 rotates in a clockwise direction. In addition, since the recirculation connection gear 36 rotates in the clockwise direction integrally with the motor connection gear 32, the recirculation gear 40 engaged with the recirculation connection gear 36 rotates in the counterclockwise direction. Therefore, the recirculation valve 45 operates to open the exhaust gas inflow passage 14. Furthermore, since the intake air connection gear 34 integrally rotates in the clockwise direction together with the motor connection gear 3, the intake air connection gear 34 is engaged with the intake air gear 50. When the intake air connection gear 34 is engaged with the intake air gear 50, the intake air inflow passage 12 is closed. The moment the intake air inflow passage 12 starts to be closed may be set based on the arrangement of the gear omission unit 38 by a person having ordinary skill in the art so as to enable the intake air inflow passage 12 to start to be closed while the opening of the exhaust gas inflow passage 14 is occurring.

FIG. 6 illustrates a configuration wherein the exhaust gas inflow passage 14 is fully open, and the intake air inflow passage 12 is close.

Referring to FIG. 6, the exhaust gas inflow passage 14 becomes fully open while the intake air inflow passage 12 is closed since the intake air connection gear 34 further rotates in the clockwise direction from the state in FIG. 5.

When the exhaust gas inflow passage 14 is fully open, the gear teeth of the recirculation gear 40 in which the gear teeth are formed on the fan shape separate from the recirculation connection gear 36, and the recirculation gear 40 and the recirculation connection gear 36 may be disengaged. That is, when the exhaust gas inflow passage 14 is fully open, the recirculation connection gear 36 idles and does not engaged with the recirculation gear 40. The above-described operation, in which the recirculation gear 40 and the recirculation connection gear 36 are disengaged, may be implemented based on the design of a person having ordinary skill in the art, but is not limited thereto. It is does not matter whether the recirculation gear 40 and the recirculation connection gear 36 are engaged.

When the motor gear 20 rotates in the clockwise direction from the state in FIG. 6, the components may return through the state in FIG. 5 to the state in FIG. 4. Since the recirculation connection gear 36 rotates in the counterclockwise direction, the recirculation gear 40 rotates in the clockwise direction.

A lost motion section (not shown) may be implemented, and the rotation of the intake air gear 50 based on the rotation of the connection gear 30 may not occur based on the arrangement of the gear omission unit 38 designed by a person having ordinary skill in the art. Therefore, the recirculation valve 45 and the intake air throttle valve 55 rotate with a predetermined time difference, and the area where the engine uses the recirculation exhaust gas may increase due to the above time difference. The clockwise direction and the counterclockwise direction in the descriptions of FIG. 4 to FIG. 6 are defined when viewing the drawings for convenient descriptions, and may change based on viewing directions or the arrangement of the components.

Figure 7:
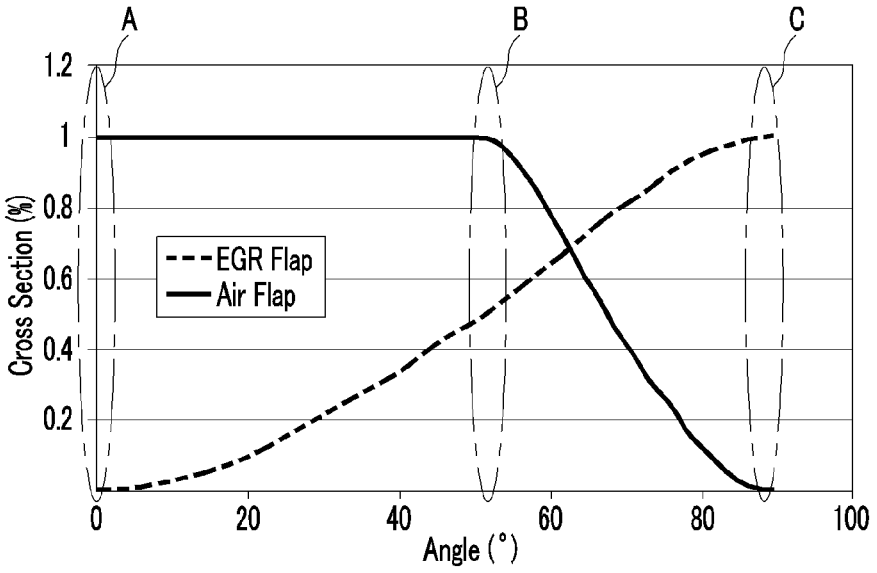
FIG. 7 is a graph illustrating opening and closing operations of an intake air valve and a recirculation valve according to an exemplary embodiment of the present inventive concept.

FIG. 7 is a graph illustrating opening and closing operations of an intake air valve and a recirculation valve according to an exemplary embodiment of the present inventive concept.

The vertical axis on the graph in FIG. 7 indicates a degree in percent when the intake air throttle valve 55 and the recirculation valve 45 open the intake air inflow passage 12 and the exhaust gas inflow passage 14, respectively, and the horizontal axis indicates a rotational angle of the intake air throttle valve 55 and the recirculation valve 45. In addition, "0" on the horizontal axis represents a state where the intake air inflow passage 12 or the exhaust gas inflow passage 14 is fully closed, but such a state is assumed only for visual understanding, and the intake air which passes through the intake air inflow passage 12 is not actually completely blocked. Further, "1" represents a state where the intake air inflow passage 12 or the exhaust gas inflow passage 14 is fully open. The operation curve of the intake air throttle valve 55 is indicated by the solid line, and the operation curve of the recirculation throttle vale 45 is indicated by the dotted line.

The section "A" on the graph in FIG. 7 represents a section in which the intake air inflow passage 12 is open and the exhaust gas inflow passage 14 is closed (refer to FIG. 4). In addition, the section "B" represents a section wherein the closing of the intake air inflow passage 12 starts while the exhaust gas inflow passage 14 starts opening (refer to FIG. 5). Furthermore, the section "C" represents a section wherein the intake air inflow passage 12 is fully closed since the closing of the intake air inflow passage 12 occurs (refer to FIG. 6) in a state where the exhaust gas inflow passage 14 is open.

FIG. 7 visually illustrates the operation of the intake air control apparatus 1 when the rotation of the intake air throttle valve 55 starts so as to close the intake air inflow passage 12 while the recirculation valve 45 and the intake air throttle valve 55 rotate with a predetermined time difference, and the recirculation valve 45 rotates to open the exhaust gas inflow passage 14.

As described above, according to the exemplary embodiments of the present inventive concept, it is possible to prevent the valve housing from being exposed to a high temperature by performing recirculation of the exhaust gas in the intake air section of the engine. Therefore, it is possible to secure operation performance and durability while saving manufacturing cost. In addition, since an area of the recirculation exhaust gas expands, emission of the exhaust gas may be reduced, and recirculation efficiency of the exhaust gas may be improved.

While this inventive concept has been described in connection with what is presently considered to be practical exemplary embodiments, it is to be understood that the inventive concept is not limited to the disclosed embodiments, but, on the contrary, is intended to cover various modifications and equivalent arrangements included within the spirit and scope of the appended claims.

What is claimed is:

1. An intake air control apparatus of an engine, comprising:

a housing including an intake air inflow passage for receiving external air, an exhaust gas inflow passage for receiving recirculated exhaust gas, and an intake air supply passage for supplying the external air from the intake air inflow passage or the recirculated exhaust gas from the exhaust gas inflow passage to the engine;

a motor which is a driving force source;

a controller configured to control the motor;

a motor gear rotating together with an output shaft of the motor;

a connection gear directly engaged and rotating together with the motor gear;

a recirculation gear directly engaged and rotating together with the connection gear;

a recirculation valve disposed inside the exhaust gas inflow passage to open and close the exhaust gas inflow passage by rotating together with the recirculation gear;

an intake air gear directly engaged and rotating together with the connection gear; and an intake air throttle valve disposed inside the intake air inflow passage to open and close the intake air inflow passage by rotating together with the intake air gear, wherein the connection gear is a three-shift gear having a motor connection gear rotatably directly engaged with the motor gear, a recirculation connection gear rotatably directly engaged with the recirculation gear recirculation gear, and an intake air connection gear rotatably directly engaged with the intake air gear, wherein the motor connection gear, the recirculation connection gear, and the intake air connection gear integrally rotate, and wherein the housing is made of an aluminum material.

2. The apparatus of claim 1, wherein the recirculation valve and the intake air throttle valve rotate with a predetermine time difference since the connection gear and the intake air gear are engaged with each other at a moment in which the motor rotates the recirculation valve when the recirculation valve closes the exhaust gas inflow passage and the intake air throttle valve opens the intake air inflow passage.

3. The apparatus of claim 1, wherein the intake air connection gear includes a gear omission unit at which gear teeth of the intake air connection gear are omitted at a predetermined angle.

4. The apparatus of claim 3, wherein gear teeth of the intake air gear are positioned at the gear omission unit of the intake air connection gear when the recirculation valve closes the exhaust gas inflow passage and the intake air throttle valve fully opens the intake air inflow passage.

5. The apparatus of claim 4, wherein the intake air connection gear and the intake air gear are engaged with each other as the connection gear rotates while the recirculation valve opens the exhaust gas inflow passage by operation of the motor.

6. The apparatus of claim 5, wherein the recirculation gear has a fan shape on which gear teeth are formed at an obtuse angle.

7. The apparatus of claim 6, wherein the intake air gear maintains the engagement with the intake air connection gear and rotates to close the intake air inflow passage by the intake air throttle valve after the recirculation valve fully opens the exhaust gas inflow passage.

8. The apparatus of claim 1, wherein the intake air gear has a fan shape on which gear teeth thereof are formed at an obtuse angle.

9. The apparatus of claim 1, wherein the recirculation gear has a fan shape on which gear teeth thereof are formed at an obtuse angles.

10. The apparatus of claim 1, wherein the recirculation valve includes a recirculation valve shaft at a center of rotation of the recirculation valve and the recirculation gear, and the recirculation valve shaft is connected to the recirculation gear to integrally rotate the recirculation valve and the reduction gear.

11. The apparatus of claim 10, wherein the recirculation valve shaft is rotatably connected to the housing.

12. The apparatus of claim 1, wherein the intake air throttle valve includes an intake air valve shaft at a center of rotation of the intake air throttle valve and the intake air gear, and the intake air valve shaft is connected to the intake air gear to integrally rotate the intake air throttle valve and the intake air gear.

13. The apparatus of claim 12, wherein the intake valve shaft is rotatably connected to the housing.

14. The apparatus of claim 1, wherein the exhaust gas inflow passage is selectively open and closed in accordance with a control of the controller.

15. The apparatus of claim 1, wherein the intake air inflow passage is selectively open and closed in accordance with a control of the controller.

* * * * *